US008752536B2

(12) United States Patent
Sims et al.

(10) Patent No.: US 8,752,536 B2
(45) Date of Patent: Jun. 17, 2014

(54) FALL-AWAY ARROW REST

(76) Inventors: Steven C. Sims, Shelton, WA (US); George Clark, Lacey, WA (US); Scott Eastman, Dupont, WA (US); Johnathan F. Sell, Shelton, WA (US); Greg Winters, Shelton, WA (US)

( * ) Notice: Subject to any disclaimer, the term of this patent is extended or adjusted under 35 U.S.C. 154(b) by 543 days.

(21) Appl. No.: 12/008,391

(22) Filed: Jan. 9, 2008

(65) Prior Publication Data

US 2008/0236556 A1 Oct. 2, 2008

Related U.S. Application Data

(60) Provisional application No. 60/879,909, filed on Jan. 10, 2007.

(51) Int. Cl.
*F41B 5/22* (2006.01)
*F41B 5/20* (2006.01)
*F41B 5/14* (2006.01)

(52) U.S. Cl.
CPC ..... *F41B 5/143* (2013.01); *F41B 5/1426* (2013.01)
USPC ..... 124/44.5; 124/24.1; 124/25.6; 124/86; 124/88

(58) Field of Classification Search
CPC ..... F41B 5/22; F41B 5/143; F41B 5/1426
USPC ..... 124/24.1, 25, 44.5, 88, 90, 25.6, 86
See application file for complete search history.

(56) References Cited

U.S. PATENT DOCUMENTS

| | | | | | |
|---|---|---|---|---|---|
| 4,453,528 | A * | 6/1984 | Eckert | 124/44.5 |
| 5,065,731 | A * | 11/1991 | Smith | 124/44.5 |
| 5,117,803 | A * | 6/1992 | Johnson | 124/44.5 |
| 5,245,980 | A * | 9/1993 | Colvin | 124/24.1 |
| 5,251,606 | A * | 10/1993 | Colvin | 124/44.5 |
| 5,365,912 | A * | 11/1994 | Pittman | 124/44.5 |
| 5,415,154 | A * | 5/1995 | Angeloni | 124/44.5 |
| 5,421,314 | A * | 6/1995 | Kidney | 124/44.5 |
| 5,460,152 | A * | 10/1995 | Specht | 124/44.5 |
| 5,467,759 | A * | 11/1995 | Troncoso | 124/44.5 |
| 5,490,492 | A * | 2/1996 | Savage | 124/44.5 |
| 5,555,875 | A * | 9/1996 | Martin et al. | 124/44.5 |
| 5,606,961 | A * | 3/1997 | Basik et al. | 124/44.5 |
| 6,202,635 | B1 * | 3/2001 | Evans | 124/44.5 |
| 6,298,842 | B1 * | 10/2001 | Sims | 124/89 |
| 6,595,195 | B1 * | 7/2003 | Barner et al. | 124/44.5 |
| 6,615,813 | B1 * | 9/2003 | Troncoso et al. | 124/44.5 |
| 6,634,349 | B2 * | 10/2003 | Mizek et al. | 124/44.5 |
| 6,789,536 | B1 * | 9/2004 | Summers | 124/44.5 |
| 6,904,900 | B2 * | 6/2005 | Gallops, Jr. | 124/25.6 |

(Continued)

*Primary Examiner* — Gene Kim
*Assistant Examiner* — Alexander Niconovich
(74) *Attorney, Agent, or Firm* — Wells St. John, PS

(57) ABSTRACT

Fall away arrow rests for archery bows. The rests have an arm with an arrow-supporting feature and an arm-associated axle which pivots the arm to displace the arrow-supporting feature between a first, arrow-loading position and a second, more elevated, arrow-launching position. The arrow support arm can be adjusted vertically, laterally, and in fore-and-aft directions relative to a riser or other rigid bow component on which the rest is mounted. One or more dampers can be advantageously attached to arrow rest structural members to reduce shock and vibrations, including noise, as the arrow support arm displaces the arrow-supporting feature between its first and second positions, especially as an arrow is launched from the bow.

10 Claims, 7 Drawing Sheets

(56) References Cited

U.S. PATENT DOCUMENTS

| | | | | |
|---|---|---|---|---|
| 6,913,008 | B2 * | 7/2005 | Simo et al. | 124/44.5 |
| 7,100,591 | B2 * | 9/2006 | Terry | 124/44.5 |
| 7,165,543 | B2 * | 1/2007 | Simo et al. | 124/44.5 |
| 7,219,662 | B1 * | 5/2007 | Henry | 124/44.5 |
| 7,331,338 | B2 * | 2/2008 | Mizek | 124/44.5 |
| 7,409,950 | B2 * | 8/2008 | Ellig et al. | 124/44.5 |
| 7,597,095 | B2 * | 10/2009 | Grace et al. | 124/44.5 |
| 7,681,566 | B2 * | 3/2010 | Mertens | 124/44.5 |
| 7,717,103 | B2 * | 5/2010 | Johnson | 124/44.5 |
| 7,748,371 | B1 * | 7/2010 | Doty | 124/44.5 |
| 7,980,237 | B1 * | 7/2011 | Rasor et al. | 124/44.5 |

* cited by examiner

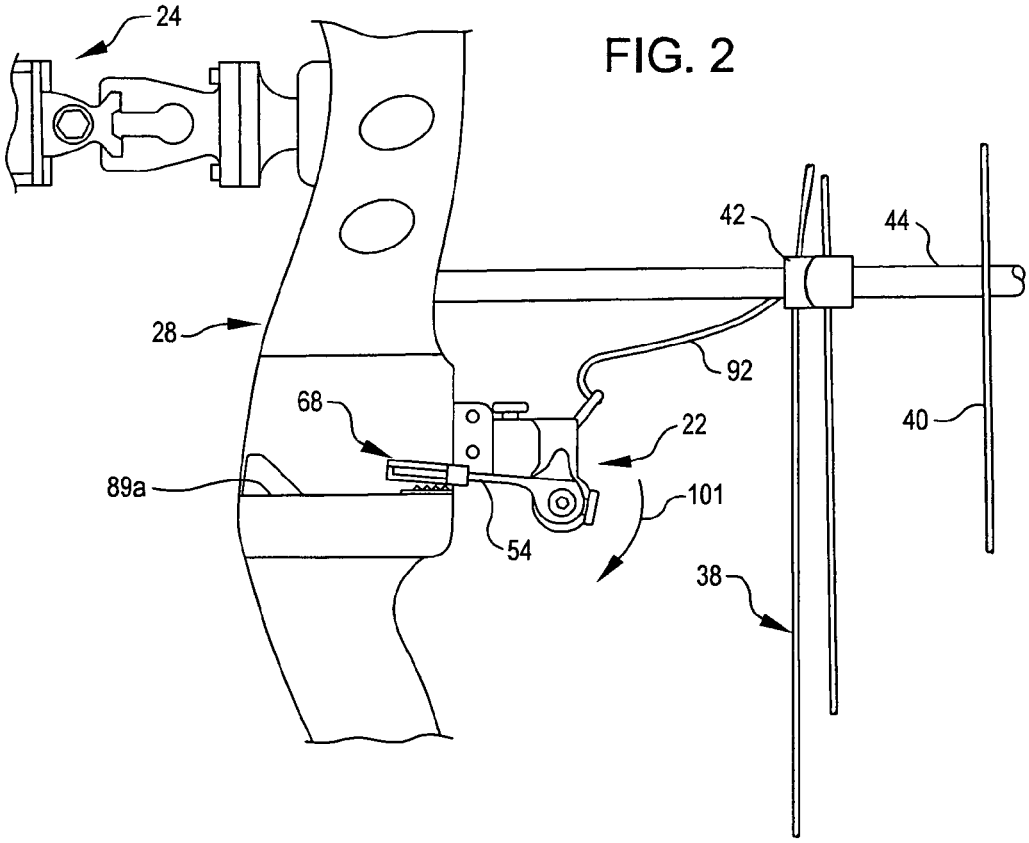
FIG. 2
FIG. 3
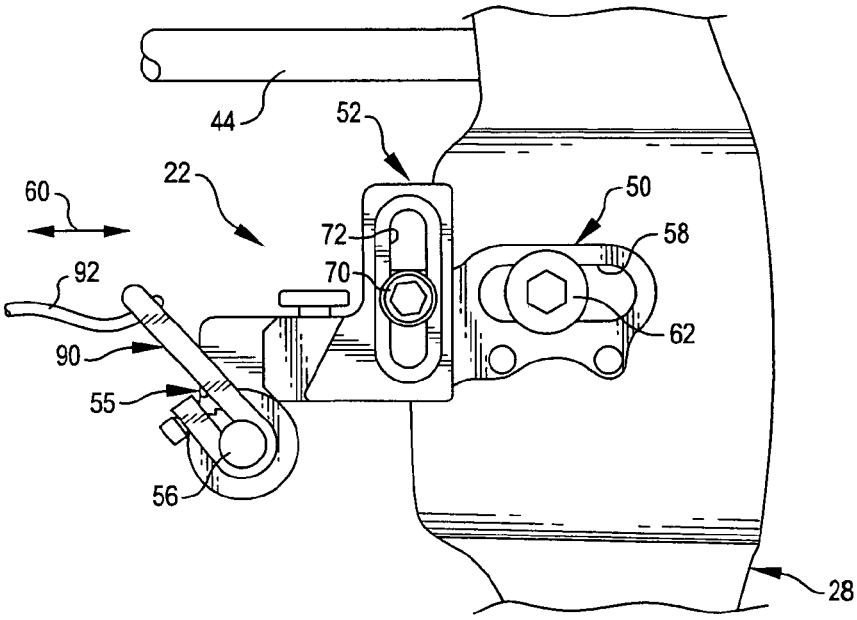

FALL-AWAY ARROW REST

CROSS-REFERENCE TO A RELATED APPLICATION

The priority of provisional application No. 60/879,909 is claimed.

TECHNICAL FIELD OF THE INVENTION

The present invention relates to novel, improved arrow rests for compound bows.

BACKGROUND OF THE INVENTION

Arrow rests are employed to hold the arrow in position until a bow is fired. This makes for a more accurate shot than positioning the arrow with the archer's hand does.

Three types of arrow rests are available: shoot-thru, containment, and fall-away.

Shoot-thru rests have the disadvantage that a fletch may contact the rest as the arrow passes through it. This can disrupt the flight of the arrow, leading to an inaccurate shot, and can damage the fletch. Also, there is nothing to keep the arrow from falling off the rest.

Some containment rests also allow the fletching to contact the rest, leading to fletch damage and an inaccurate shot when the bow is fired. Containment rests designed to eliminate fletch-and-rest contact require precise nock and fletching alignment and can be difficult to use.

Unlike shoot-thru rests, fall-away rests hold the arrow firmly in position until the bow is fired. At this point, drop out of the path of the arrow, eliminating fletch clearance problems.

SUMMARY OF THE INVENTION

Disclosed herein are new and novel arrow rests of the fall-away type.

One important advantage of these arrow rests is that they employ a construction which allows them to be mounted to a wide variety of bows.

They also have a wide range of adjustment features, allowing performance to be optimized for the particular bow with the rest is employed.

The arrow rests of the present invention are rock solid, and they have bearings which make operation of the rests smooth and quiet.

Adjustable stops allow the arrow-supporting arm of the rest to be positioned to support the arrow at the optimum height when the bow is drawn and to insure that the arm does not hit the shelf of the arrow rest when the arrow leaves the bow and the arm returns to its initial position. Other adjustment features can be employed to insure that the bow string moves in a straight line when the bow is fired, instead of being pulled toward the side of the bow as is common with some bows.

The rest is furthermore constructed such that it can be optimally located both vertically and horizontally with respect to the bow when it is mounted to the riser of the bow. This, together with coarse and fine adjustments, allow the initial angle, stroke, and height of the arrow-supporting arm to be adjusted to suit the archer.

The arrow-supporting arm accepts an easily and quickly added Teflon, or comparable, support, further quieting the bow when the arrow is fired.

Significant additional quieting and smoothness of operation is obtained by mounting elastomeric shock and vibration dampers to the rest in locations providing for optimum damping.

Operation of the arrow rest is typically effected by tying a string between a member coupled to the arm for rotation therewith and the cable slide or buss cable of a compound bow. The string can be attached to the rest at any of multiple locations, allowing one to optimize the pressure required to cause the arm to drop and the speed with which that occurs.

BRIEF DESCRIPTION OF THE DRAWINGS

FIG. 2 is a view similar to FIG. 1 but to an enlarged scale;

FIG. 3 is a side view of the rest and a fragment of the bow;

DESCRIPTION OF THE INVENTION

Important features of the present invention are described below with reference to the drawings. This list is not to be taken as all-inclusive.

Figure 1:
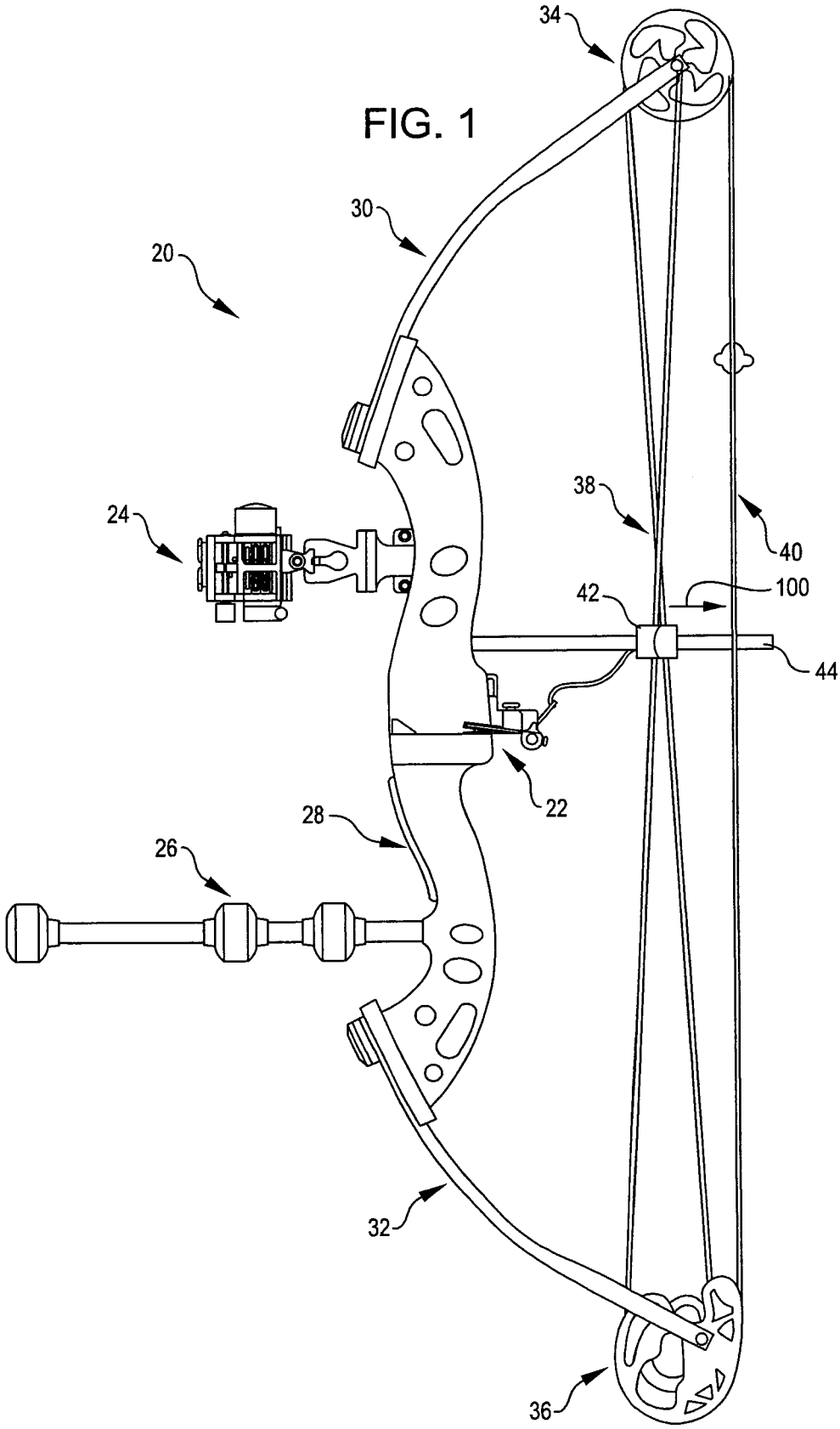
FIG. 1 is a side view of a compound bow equipped with a fall-away arrow rest; the rest embodies and is constructed in accord with the principles of the present invention.

Referring now to the illustrations, FIGS. 1 and 2 depict a compound bow 20 equipped with a fall-away arrow rest 22, an optical sight 24, and a modular stabilizer 26.

Bow 20 is of conventional construction. It has a riser 28, upper and lower limbs 30 and 32, cams 34 and 36 at the far ends of limbs 30 and 32, buss cables (collectively identified by reference character 38), a bow string 40, and a cable slide 42 mounted on an elongated guide 44.

Arrow rest 22 includes brackets 50 and 52, an arrow support and stabilizing arm 54, an axle housing 55, and a transversely extending axle (or shaft) 56, which is rotatable in but fixed lengthwise of housing 55. The proximate end 57 of arm 54 is assembled to axle 56 for rotation therewith.

An elongated slot 58 in support bracket 50 allows the rest to be adjusted in a fore-and-aft direction with respect to the riser 28 of bow 20; i.e., in the directions indicated by double-headed arrow 60 in FIG. 3. A first, releasable, threaded fastener 62 secures bracket 50 in the position to which it is adjusted.

The arrow 64 being fired (see FIGS. 7 and 8) is supported from the free, distal end 66 of arm 54 directly in a V-shaped notch 67 or in an optional, notched, snap-on arrow support component 68 made of Teflon or other material with a low coefficient of friction.

The bracket 52 of arrow rest 22 is secured to bracket 50 by a second, releasable, threaded fastener 70, which extends through a vertically elongated slot 72 in bracket 52. This allows the initial position at which arrow 64 is loaded onto arrow support 54 to be vertically adjusted as appropriate for a particular bow and arrow.

Figure 5:
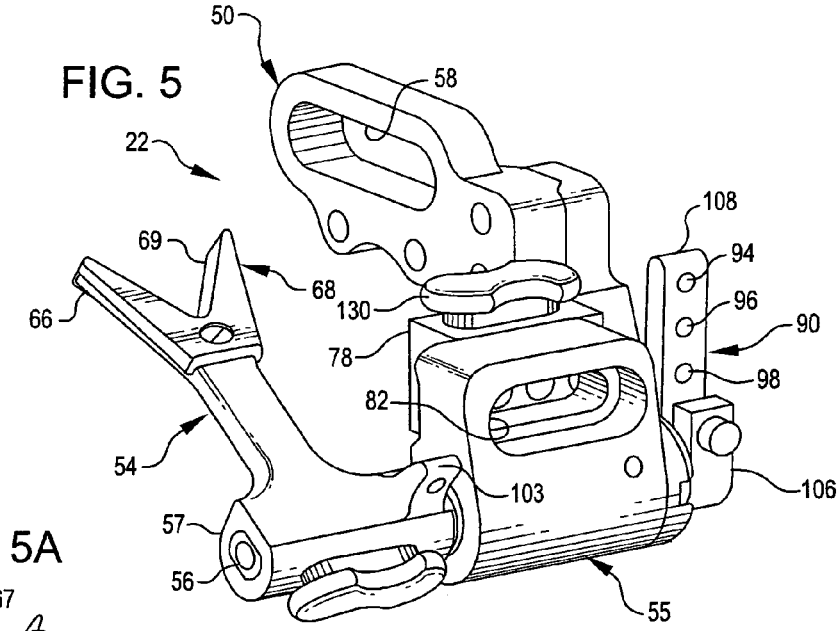
FIG. 5 is a plan view of an arrow-supporting component of the rest.
Figure 5A:
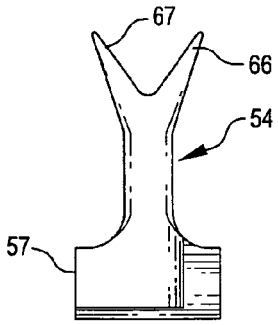
Figure 6:
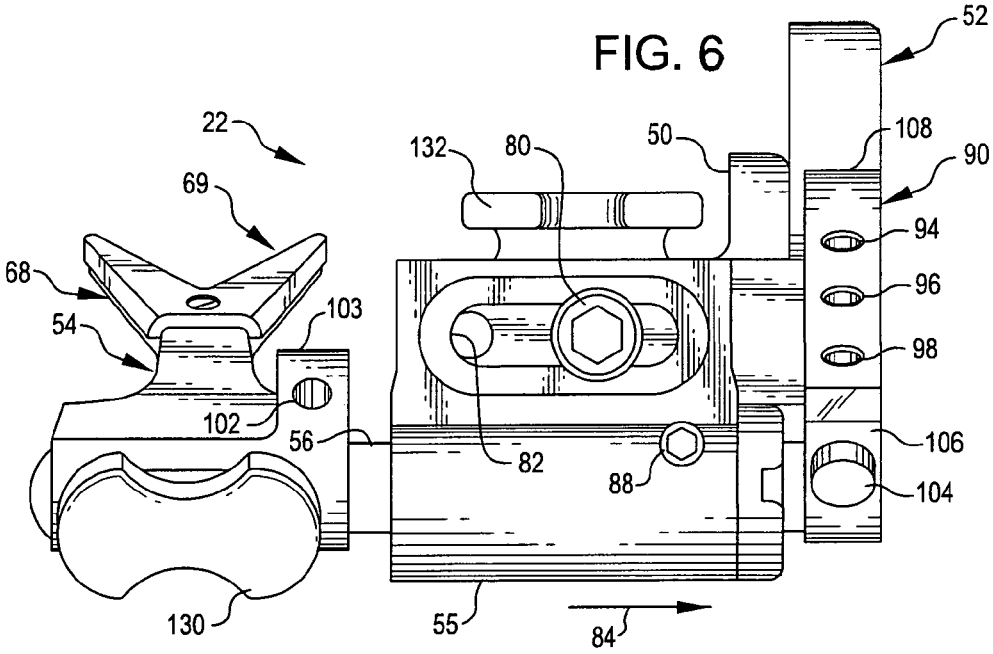
FIG. 6 is a perspective view, looking at the front of the rest.

The supporting component 54 for arrow 64 can also be adjusted laterally with respect to the riser 28 of the bow on which fall-away rest 22 is mounted, in this exemplary embodiment of the invention. Specifically, axle housing 55 is attached to a laterally extending arm 78 of bracket 52 (see FIG. 5), by which arrow-supporting component 54 is supported by a third, releasable, threaded fastener 80 (see FIG. 6). The fastener extends through a laterally elongated slot 82 in the upper part of the axle housing. Axle housing 55 can accordingly be moved laterally relative to bracket 502 as shown by the double-headed arrow 84 in FIG. 6. Axle 56 and arrow-supporting arm 54 are shifted in the same direction and for the same distance to locate the arrow-supporting component 54 in the desired lateral location. Tightening the fastener then retains axle housing 55 and, therefore, arrow support 54 in the selected lateral location.

Stops 86 and 88 (see FIG. 6) limit: (1) the downward rotational movement of arrow support 54 and arrow-supporting element 66 (or 68) to a rest position in which arrow 64 is loaded onto the rest to ready bow 20 for a shot, and (2) the rotational, upward movement of the arm and concomitant elevation of arrow 64 to its firing (or launch) position (FIG. 8) effected when the bow is drawn. These stops are threaded through non-rotatable axle housing 55 into complementary, radially oriented, slanted slots formed in axle 56 (the recess in which upper stop 88 is seated is identified in FIG. 9 by reference character 89). When the end of the stop reaches the bottom of the companion recess, the axle 56 is locked against further rotation.

An arm 90 (see FIG. 3) is attached to that end of shaft 56 opposite arrow support 54 and rotates with the shaft. Arm 90 is tied to cable slide 42 (or a buss cable 38) by an inelastic string 92. The cable slide option is shown in the drawings.

Figure 4:
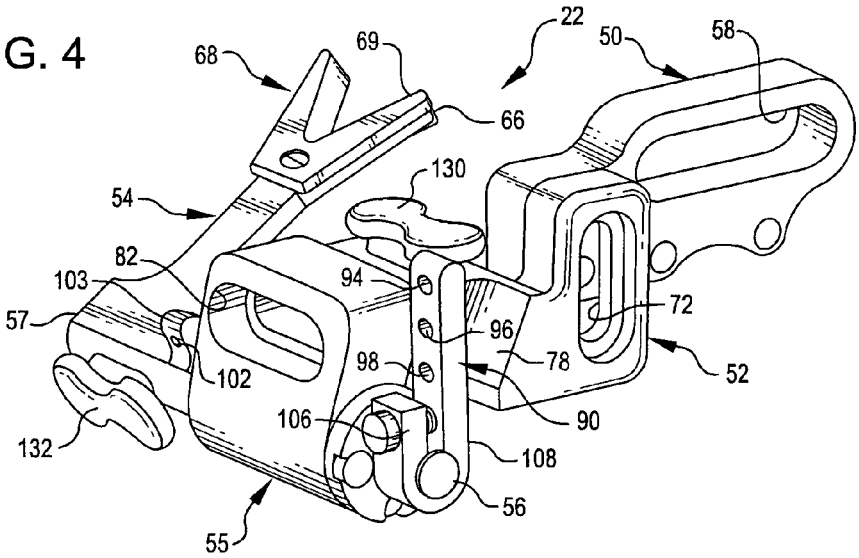
FIG. 4 is a perspective view of the rest, looking from the front toward the rear of the rest.

String 92 is trained through a selected one of the three apertures 94, 96, 98 in arm 90. When the bow is drawn, cable slide 42 moves in the direction indicated by arrow 100 in FIG. 1. This pulls on the upper end of arm 90, rotating axle 56 counterclockwise (as shown in FIG. 4), rotatably displaces arrow support 54 notch 67 (or 68) from its initial, arrow-loading position to the elevated position from which the arrow is launched (see FIG. 8).

Before the bow is fully drawn, string 92 becomes taut; and further movement of cable slide 42 and buss cables 38 is thereby prevented, a condition known as "lock-up". However, the archer will continue to draw the bow until full draw is reached, typically an additional 2-4 (or more) inches.

The three apertures 94, 96 and 98 in arm 90 allow the archer to choose the distance the cable slide 42 and buss cables 38 travel before bow 20 locks up. With string 92 tied through the lowest hole 98, bow 20 will lock up the fastest when it is drawn. As the string attachment point is moved upwardly to aperture 96 and then aperture 94, the lock-up time increases; and the distance the bow string 40 moves from lock-up to full draw increases because the string travels further before lock-up, whereas the draw of the bow remains unchanged irrespective of the point at which lock-up occurs.

String 92 can, as an alternative, be tied through an aperture 102 in a second arm 103 which also rotates with shaft 56. Arm 103 is located at the opposite end of the shaft from arm 90, and it is an integral element of the pivotable arrow support 54. String attachment arm 102 accommodates bows in which there is a tendency for a string such as that identified by reference character 92 to pull sideways as the bow is drawn.

A finer adjustment of the point at which lock-up occurs can be made by: (a) loosening a fastener 104 which extends through one integral element 106 of arm 90 and is threaded into a complementary, also integral, arm element 108 on the opposite side of shaft 56, (b) rotating arm 90 relative to shaft 56, and (c) retightening fastener 104. This couples arm 90 to shaft 56, fixing the angle through which the shaft and arrow support 54 can rotate over the full pull of string 92.

Figure 9:
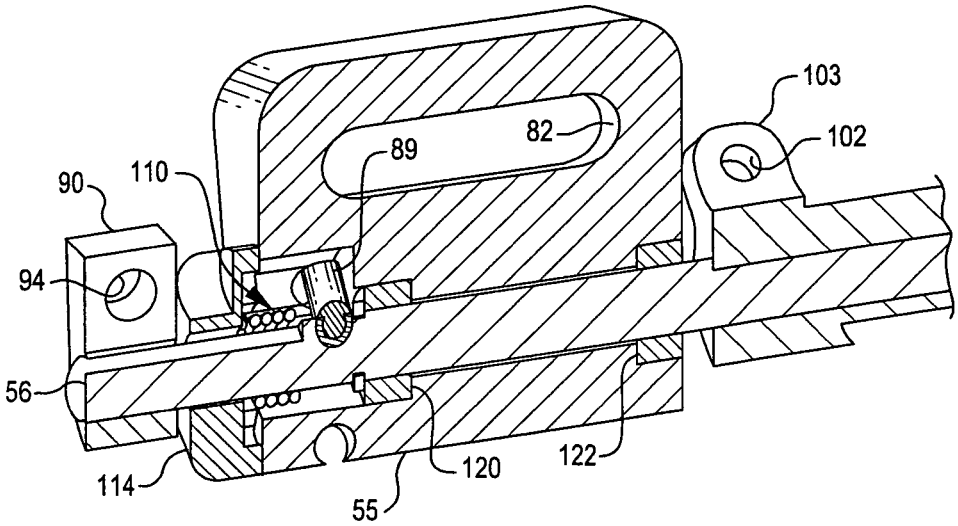
FIG. 9 is a vertical section presented primarily to show the details of a coil spring mechanism which restores the arrow-supporting arm of the rest from its firing position to its downwardly rotated, arrow-loading position when an arrow is fired.
Figure 9A:
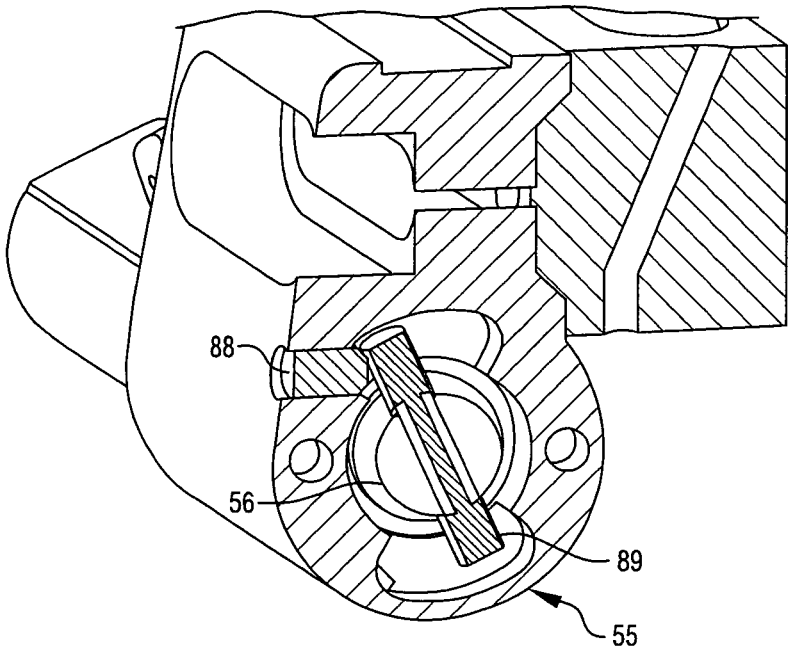

Referring now to FIG. 9, as bow 20 is drawn and shaft 56 rotates, a coil spring motor 110 in arrow rest housing 52 is wound. To this end, one end of the spring is attached to shaft 56; and the opposite end is fitted into one of the multiple apertures 112 in a stationary end cap 114 (see also, FIG. 10).

Figure 8:
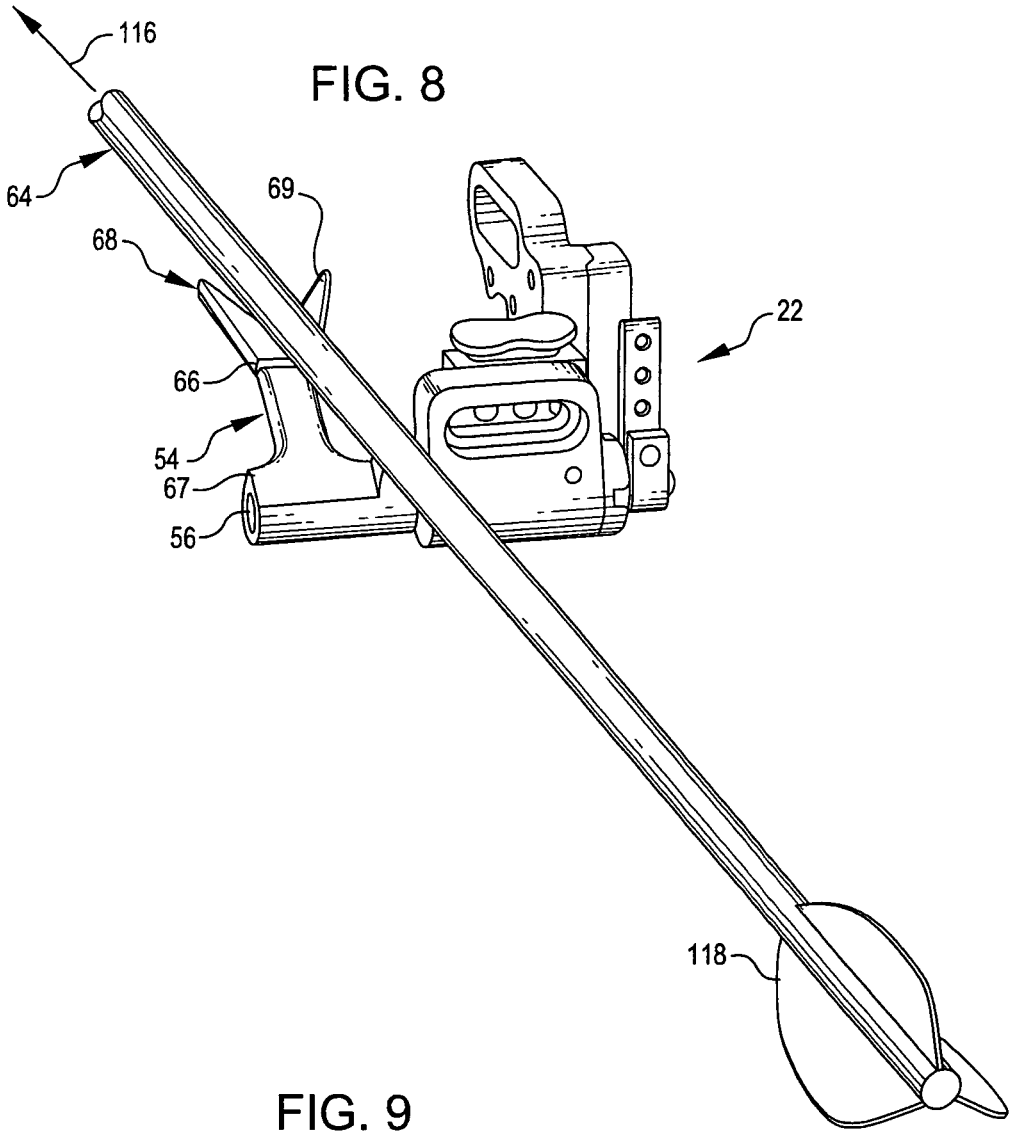
FIG. 8 is a perspective view of the rest and arrow with the arrow-supporting arm of the rest rotated upwardly to elevate the arrow to its firing position.

When bow 20 is drawn and bow string 40 subsequently released, arrow 64 is propelled in the direction indicated by arrow 116 in FIG. 8. As the arrow gathers speed, it is initially supported by support 54 to stabilize the arrow. Shortly thereafter, however, spring 110 begins to unwind, rotating shaft 56 and arrow support arm 54 downwardly toward its initial, arrow-loading position, thus moving it out of the way of the fletches 118 on the arrow 64 being fired from the bow. As discussed above, this is important both from the viewpoint of accuracy and that of avoiding damage to the fletches.

Figure 10:
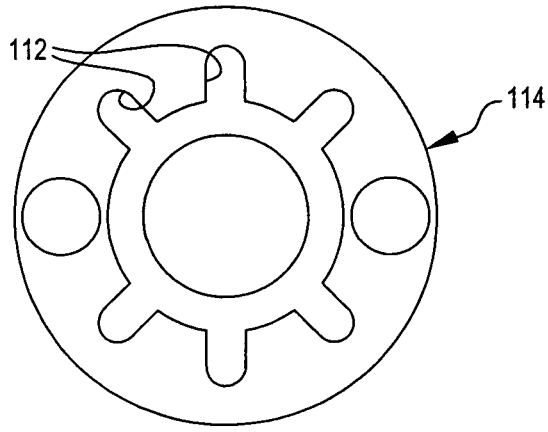
FIG. 10 is an end view of a stationary cap with features which allow one of multiple, different tensions on the coil spring to be selected.

The particular aperture 112 in which the complementary end of spring 110 is installed determines the tension imposed upon the spring as it is wound and, as a consequence, the speed with which arm 54 is restored toward its initial position when the bow strong 40 is released. By providing multiple points as shown in FIG. 10, an optimum tension in the wound spring 110 can be realized. This ensures that the arrow rest arm 54 moves out of the way of the arrow with sufficient rapidity to avoid contact between it and the arrow fletches while, at the same time, avoiding the imposing of unnecessary stresses on components of bow 20.

Referring again to FIG. 9, shaft 56 is mounted and supported in sealed bearings 120 and 122. Needle and ball bearings are preferred as they provide for smooth and quiet operation of the arrow rest.

Figure 11:
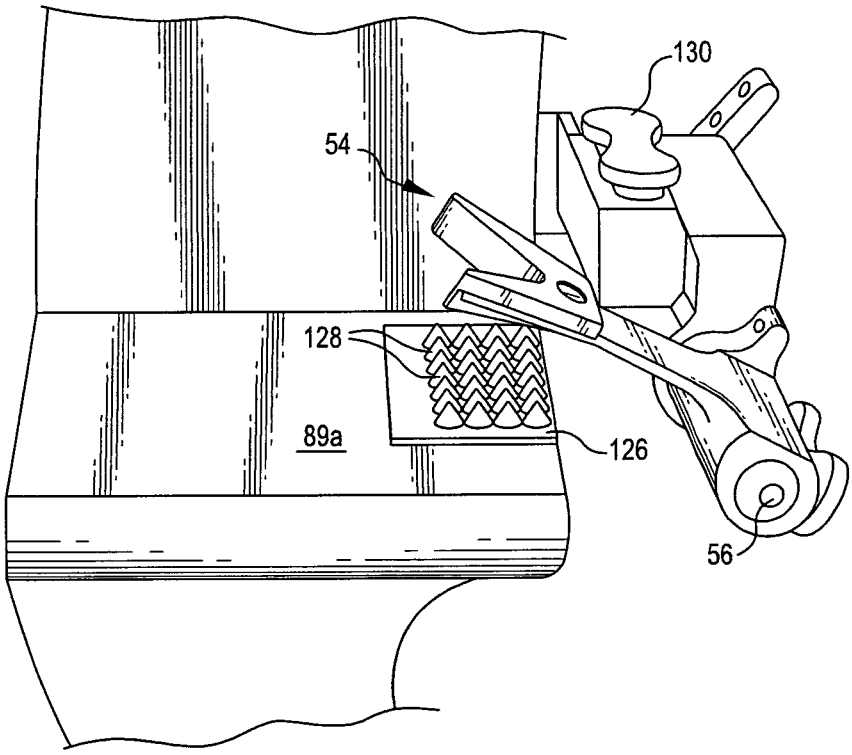
FIG. 11 shows the riser of the bow and an elastomeric pad which can be installed on the riser shelf to reduce shocks and impacts in those circumstances in which the archer elects to have the arrow-supporting arm rest on the shelf of the riser.

The archer may prefer that the pivotable arrow support 54 fall onto and rest on the shelf 124 of bow riser 28 when the support is in its initial, arrow-loading position rather than being stopped above the shelf by lower stop 86. For these individuals, a pad 126 of elastomeric material with a set of nodes 128 may be installed on the riser shelf 124 (see FIG. 11). Pad 126 significantly reduces the shock and vibration imposed on bow 20 when it is fired.

Another option that the archer may prefer is to stop the restoring arrow support component 54 just as that component reaches shelf 124. This can be achieved by outward (or inward) adjustment of lower stop 86.

Figure 7:
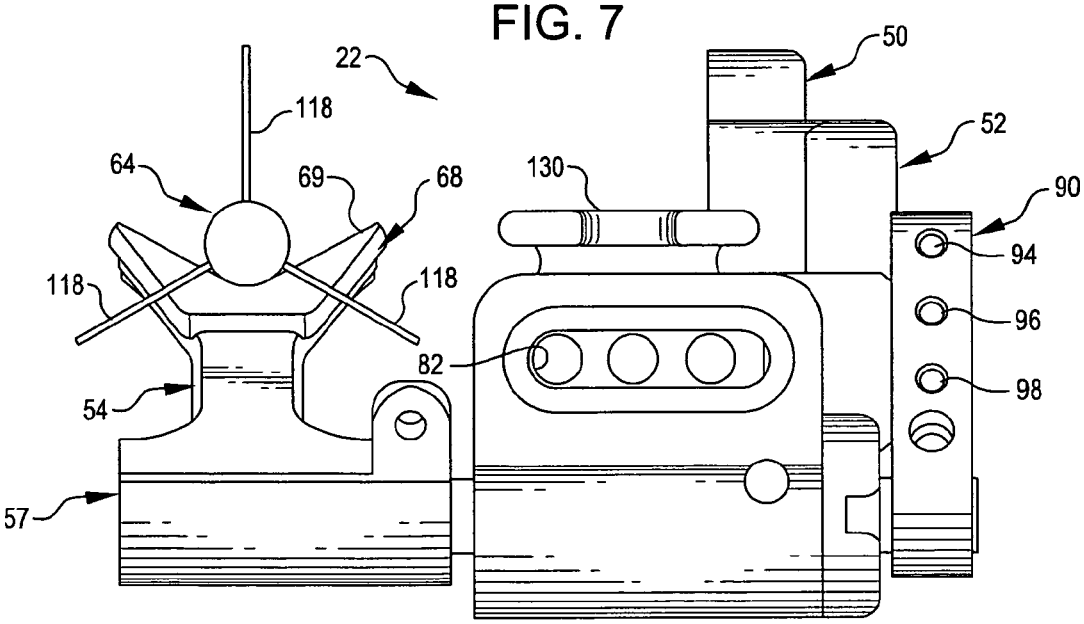
FIG. 7 is a front view of the rest and an arrow fitted onto the arrow-supporting component of the rest.

Elastomeric, shock/vibration dampers 130 and 132 are mounted on fall-away arrow rest 20 in the locations shown in FIG. 7. These dampers are of the character described in the above-cited '046 patent. Dampers 130 and 132 make a significant contribution to smooth and quiet operation of bow 20, particularly when an arrow is launched from the bow.

The principles of the present invention may be embodied in forms other than the one specifically disclosed herein. Therefore, the present embodiment is to be considered in all respects as illustrative and not restrictive, the scope of the invention being indicated by the appended claims rather than by the foregoing description; and all changes which come with the meaning and range of equivalency of the claims are intended to be embraced herein.

The invention claimed is:

1. The combination of a bow and a fall away arrow rest;

the bow having a shelf; and the fall away arrow rest comprising a pivotable arrow support arm located above the shelf of the bow;

the arrow support arm: (a) having a first, raised, arrow launching position, and (b) being pivotably displaceable at arrow launch out of the path taken by an arrow leaving the bow toward a second, arrow-loading position nearer the shelf of the bow; and the arrow rest further comprising:

a first, automatically operable stop halting the arrow support arm at the arrow loading position subsequent to arrow launch and the concomitant pivotable movement of the arm toward the arrow loading position; and a second, automatically operable stop halting the arrow support arm at the arrow launching position upon the bow being drawn and the arm consequentially pivoting away from the shelf;

the fall away arrow rest having a rotatable axle to which the arrow support arm is fixed and a non-rotatable axle housing;

first and second, stop engageable members protruding from the axle;

the first and second stops being supported in the axle housing in paths traced by the first and second stop-engageable members as the axle rotates;

the arrow-supporting segment being configured for adjustable locating relative to the bow to optimally locate the arrow-supporting segment for noise reduction and a shock/vibration absorber being installed on the shelf in a location in which absorber cushions the arrow-supporting segment of the arrow support arm as the support arm is displaced from its arrow launching position to, and reaches, its arrow loading position.

2. An arrow rest which comprises:

an arrow support arm;

a noise reducing component on an arrow-supporting segment of the arrow support arm, the arrow-supporting segment being configured for adjustable locating relative to an archery bow to optimally locate the arrow-supporting segment for noise reduction;

the arrow supporting segment having an upper surface and side surfaces depending from the upper surface; and the noise reducing component having inner upper and side surfaces facing and complementing the corresponding surfaces of the arrow-supporting segments.

3. An arrow rest comprising:

a pivotable arrow support arm;

an axle to which the arrow support arm is assembled; and an axle housing in which the axle is supported for pivotable movement effecting concomitant pivoting of the arrow support arm between a lower, arrow loading position and an elevated, arrow launching position;

a first damper mounted on the arrow support arm for reducing noise, other vibrations, and shocks generated in or by the arrow support arm: (a) as the bow is drawn and the arrow support arm pivots from its arrow loading position to its arrow launching position, (b) when an arrow is launched, and (c) as the arrow support arm pivotably returns to its arrow loading position; the first damper being externally attached to the axle.

4. An arrow rest as defined in claim 3 in which:

the arrow rest further comprises:

an arrow support arm position adjustment component; and a second damper fixed to an exterior surface of the axle housing.

5. The combination of a bow, a fall away arrow rest, and a shock/vibration absorber:

the bow having a rigid component which comprises a shelf;

the fall away arrow rest comprising an arrow support arm that includes an arrow-supporting segment, the arrow support arm being displaceable between a first, arrow loading position in which the segment rests on the shelf of the rigid bow component and a second, elevated, arrow launching position; and the shock/vibration absorber being installed on the shelf in a location in which the absorber cushions the arrow-supporting segment of the arrow support arm as the support arm is displaced from its arrow launching position to, and reaches, its arrow loading position.

6. A combination as defined in claim 5 in which the shock/vibration absorber has progressive resistance nodes on a side thereof which faces the arrow-supporting segment of the arrow support arm.

7. A fall away arrow rest which comprises:

an arrow support arm that has an arrow-supporting feature at one end thereof;

an elongated arrow support arm axle to which the arrow support arm is assembled;

an axle housing which surrounds the axle over a major, lengthwise part of the axle;

first and second bearings which are located in and toward opposite ends of the axle housing and which rotatably support the arrow support arm axle in the axle housing for movements that are effective to displace the arrow support feature between an arrow loading position and an arrow launching position; and a motor in the axle housing for so rotating the axle concomitantly with the launching of an arrow as to displace the arrow support feature away from the arrow launching position of the arrow support arm and out of the path followed by the arrow as it leaves the bow from which it is launched; and the elongated arrow support arm axle arrow-supporting segment being configured for adjustable locating relative to an archery to which it is mounted; and a first damper mounted on the arrow support arm for reducing noise, other vibrations, and shocks generated in or by the arrow support arm: (a) as the bow is drawn and the arrow support arm pivots from its arrow loading position to its arrow launching position, (b) when an arrow is launched, and (c) as the arrow support arm pivotably returns to its arrow loading position; the first damper being externally attached to the axle.

8. A fall away arrow rest as defined in claim 7 in which:

the axle-rotating motor comprises a coil spring which is wound as the bow is drawn and which returns the arrow-supporting feature to its arrow loading position upon an arrow being launched from the bow;

the coil spring being isolated from the ambient surroundings;

one end of the coil spring being fixed to the axle; and a second, opposite end of the coil spring being fixed to the axle housing.

9. The combination of:

a bow comprising a buss cable mechanism; and a fall away arrow rest;

the fall away arrow rest comprising an arrow support arm which is pivotable between a lowered, arrow loading position and an elevated, arrow launching position;

an axle to which the arrow support arm is fixed for rotation therewith;

a non-rotatable axle housing; and an axle rotating, flexible link which is connected between the axle and a component of the buss cable assembly and is capable of so rotating the axle as to pivot the arrow support arm from its arrow loading position to its arrow launching position as the bow is drawn;

an elongated, non-rotatable, radially extending, axle housing member;

that member having multiple, operation altering, attachment features spaced therealong; and the flexible link being connectable to any selected one of the attachment features to particularize the travel of the arrow support arm as the bow is drawn and the arrow support arm pivotably moves from its arrow loading position to its arrow launching position.

10. An arrow rest as recited in claim 3, and further comprising:

a second damper mounted to an exterior surface of the axle housing for reducing noise, other vibrations, and shocks generated in or by the arrow rest: (a) as the bow is drawn and the arrow support arm pivots from its arrow loading position to its arrow launching position, (b) when an arrow is launched, and (c) as the arrow support arm pivotably returns to its arrow loading position.

* * * * *